United States Patent [19]

Shyu

[11] Patent Number: 4,785,305

[45] Date of Patent: Nov. 15, 1988

[54] GLASS-MOUNTABLE ANTENNA ASSEMBLY WITH MICROSTRIP FILTER

[76] Inventor: Don Shyu, No. 957, Po Ai Street, Chu Pei Hsiang, Hsin Chu Hsien, Taiwan

[21] Appl. No.: 40,038

[22] Filed: Apr. 20, 1987

[51] Int. Cl.[4] ..... H01Q 1/32

[52] U.S. Cl. ..... 343/713; 343/715

[58] Field of Search ..... 343/711, 712, 713, 714, 343/715

[56] References Cited

U.S. PATENT DOCUMENTS 4,238,799 12/1980 Parfitt ..... 343/715
4,266,227 5/1981 Blaese ..... 343/715

FOREIGN PATENT DOCUMENTS 0137391 4/1985 European Pat. Off. ..... 343/715
3410950 9/1985 Fed. Rep. of Germany ..... 343/715
8700974 2/1987 World Int. Prop. O. .

*Primary Examiner*—William L. Sikes
*Assistant Examiner*—Doris J. Johnson
*Attorney, Agent, or Firm*—Keaty & Keaty

[57] ABSTRACT

An antenna for mounting on a non-conductive surface such as a windshield of an automobile coupled by a capacitor to housing on the inside of the resonant plate. The antenna has a jack for receiving a plug from a car radio and provides for interchangeability of the cable between the radio receiver and the jack. The circuit allows for fine tuning to the resonant frequency of the antenna.

1 Claim, 3 Drawing Sheets

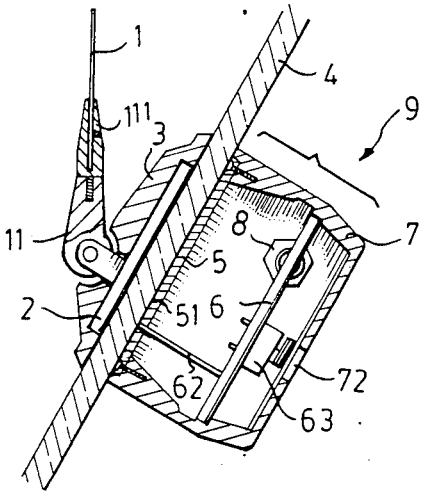
FIG. 3
FIG. 4
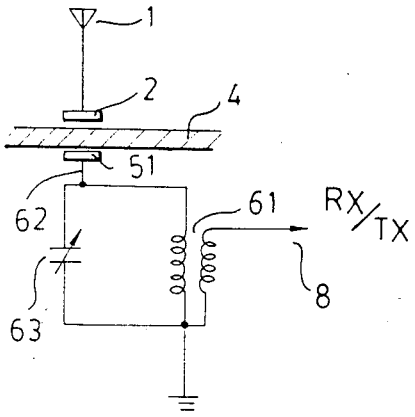

GLASS-MOUNTABLE ANTENNA ASSEMBLY WITH MICROSTRIP FILTER

BACKGROUND OF THE INVENTION

This invention relates to an antenna for non-conductive surfaces which can be mounted on one side of a non-conductive surface with the signal being electronically processed and transmitted from the inside of said surface. Previous antennas were either electrically connected through the non-conductive surface or were prohibitively expensive. Another problem with prior art antennas is that they did not provide a jack for receiving a plug so that assembly and repair would be simplified and so that interchangeability of the cable between the radio receiver and the jack would be possible. Also, it was difficult to fine tune the circuit to the resonant frequency of the antenna in the prior art.

It is the purpose of this present invention, therefore, to mitigate and/or obviate the abovementioned drawbacks in the manner set forth in the detailed description of the preferred embodiment.

SUMMARY OF THE INVENTION

A primary objective of this invention is to provide an antenna which is mountable on a non-conductive surface and which can be easily fine tuned to the resonant frequency of the antenna.

Another objective of this invention is to provide an inexpensive antenna which is mountable on non-conductive surfaces and which is coupled by a capacitor to a housing on the inside of said resonant plate.

A further objective of this invention is to provide an antenna which is mountable on non-conductive surfaces which is easy to manufacture.

Further objectives and advantages of the present invention will become apparent as the following description proceeds, and the features of novelty which characterize, the invention are pointed out with particularity in the claims annexed to and forming a part of this invention.

BRIEF DESCRIPTION OF THE DRAWINGS

FIG. 3 is a cross-sectional view of a glass-mounted antenna in accordance with the present invention in mounted position; and FIG. 4 is an electrical circuit diagram in accordance with the present invention.

DETAILED DESCRIPTION OF THE PREFERRED EMBODIMENT

Figure 1:
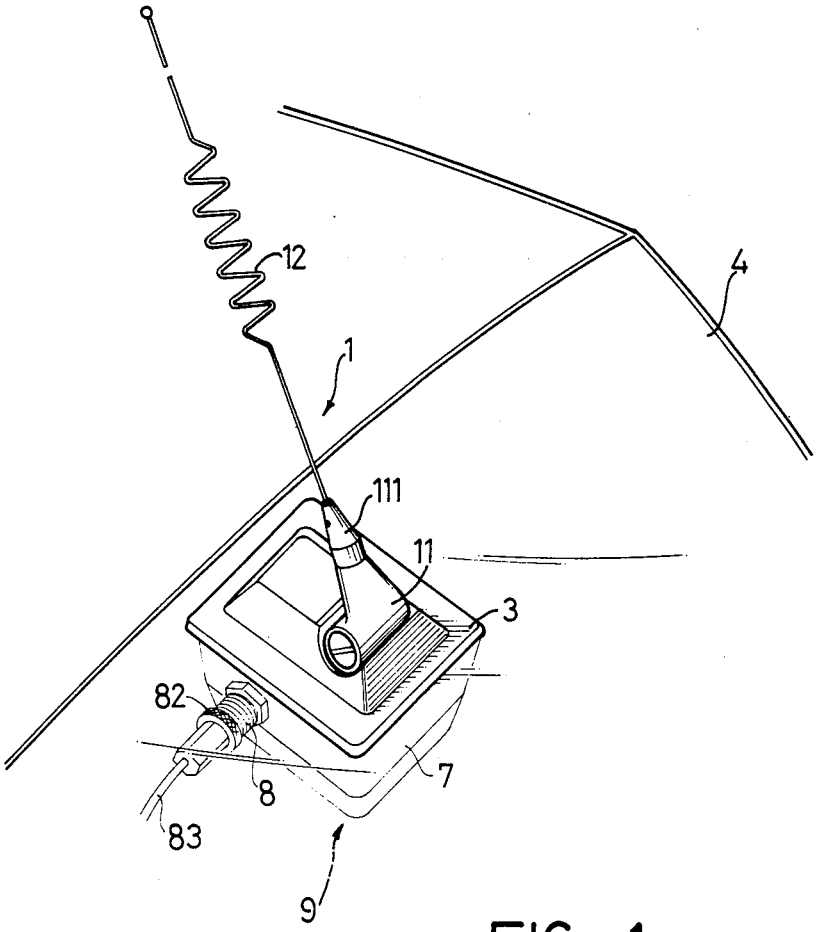
FIG. 1 is a perspective view of a glass-mounted antenna in accordance with the present invention.

Referring to FIG. 1, it can be seen that the present invention comprises an electrically-shortened antenna 1 with a flexible whip portion 12, ad antenna pivot or base 11 and antenna support 111, and an outer coupling capacitor plate 3, with all of these parts being on the outside of the non-conductive plate (or in this embodiment windshield 4). The antenna 1 may be pivoted to a desirable orientation and then tightened in place by means of screws, which are on either side of the antenna base 11. On the inside of the windshield 4, a housing 7 and a jack 8 can be seen. The jack 8 comprises a plug 82 and a conductor wire 83.

Figure 2:
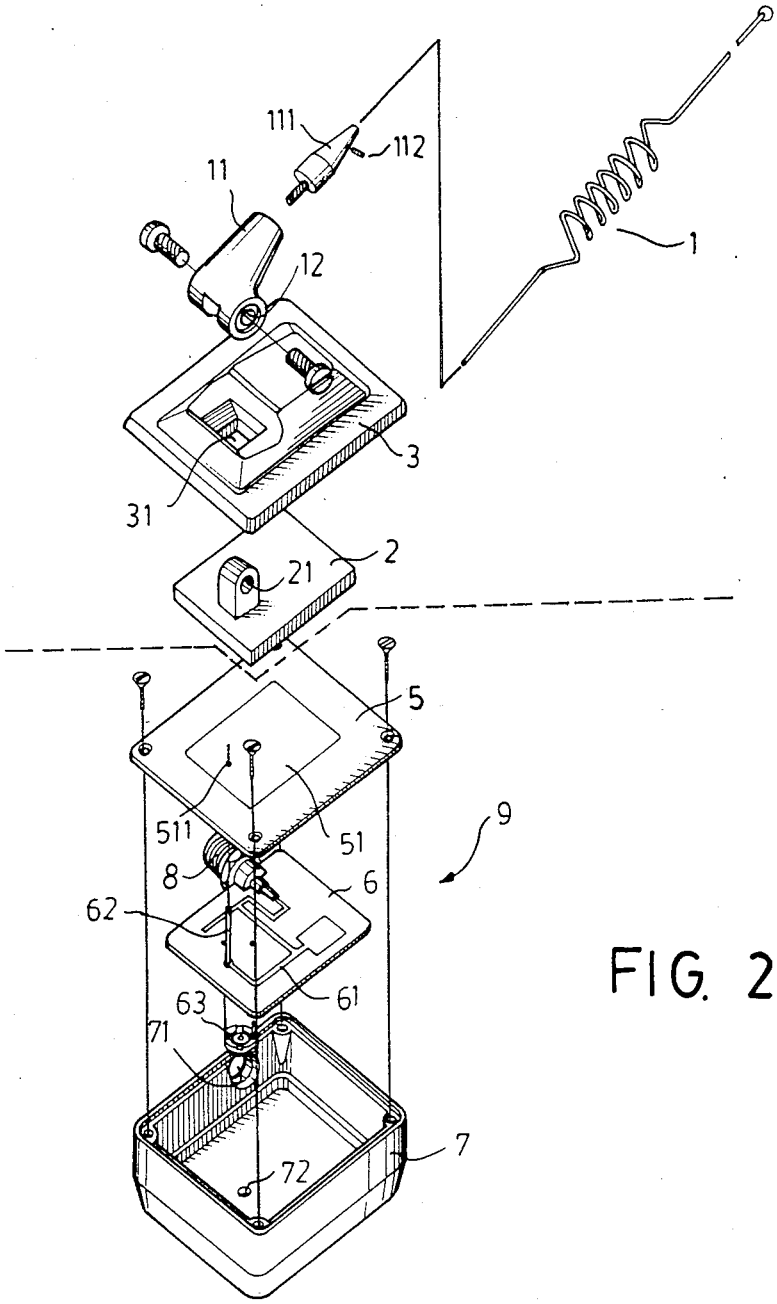
FIG. 2 is an exploded view of a glass-mounted antenna in accordance with the present invention.

Now referring to FIG. 2 and 3, the present invention will be explained in more detail. This invention comprises an antenna portion 1 and a lower housing assembly 9. Each of these two basic sections comprises a capacitor plate so that an electromagnetic signal can be transmitted through the windshield, thereby eliminating the need to drill a hole through the windshield. The upper capacitor plate 2 has an electrically conductive pivot post 21 which protrudes through a cavity 31 in an antenna base 3 to receive the signal from said antenna 1. The cavity 31 extends from a recess in the lower section of the antenna base 3 vertically through the antenna base 3. The bottom surface of the antenna base 3 fits flushly against the outside surface of the windshield (i.e. non-conductive, substantially flat surface). The upper capacitor plate 2 fits into the recess and adjacent to a lower surface of said antenna base 3. This upper capacitor plate acts as the loading plate for a lower capacitor plate 51, which is actually the top surface of a P.C. board 5.

Referring to reference numeral number 9, the lower housing assembly 9 will be described. The lower housing assembly comprises a housing 7, a microstrip plate 6, a lower capacitor plate 51, a variable capacitor 63, a metal wire 62 and a jack 8. The lower capacitor plate 51 fits flushly against the inside surface of the windshield and receives a signal from the upper capacitor plate 2, the signal is processed by a circuit essentially comprising a variable capacitor 63 and an inductor in parallel, the function of an inductor being emulated by the microstrip filter 61. Of course, the metal wire 62 acts as a simple conductor to transmit the signal from the lower capacitor plate 51 through the above-mentioned circuit to the jack 8.

As can be best seen from FIG. 3, the variable capacitor 63 is set on the microstrip filter 61 and electrically interacts therewith. The variable capacitor 63 can be adjusted through the adjustment hole 72 so that the user may easily fine tune the resonant frequency of the antenna assembly with a screwdriver or the like.

Because the lower capacitor plate 51 of the present invention is made of P.C. board, and a microstrip filter 61 serves as (emulates) an inductor, the present invention is much cheaper to produce than it would have been using conventional capacitors and inductors of equivalent rating.

In addition to the above-mentioned advantage, the housing 7 of this invention has a jack 8 which is obviously more convenient for allowing a plug to be inserted therein, so as to provide greater interchangeability and ease of installation.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. In a glass-mountable antenna assembly comprising an electrically-shortened antenna (1), an antenna base (3), an upper capacitor plate (2) capable of receiving an electromagnetic signal from said antenna (1) and transmitting said electromagnetic signal through a sheet of glass to a lower capacitor plate (5) on the opposite side of said sheet of glass, the improvement comprising:

a metal wire (62) being electrically connected to said lower capacitor plate (5) on one end thereof;

a microstrip filter (61) being electrically connected to said metal wire (62) and emulating an inductor;

a variable capacitor (63) electrically interacting with said microstrip filter (61);

a jack (8) which connects electrically with said microstrip filter (61) to receive a signal therefrom; and said housing (7) containing said microstrip filter (61), said metal wire (62), and said lower capacitor plate (5) and receiving a portion of said jack (8) therein.

* * * * *